US007391990B2

(12) United States Patent
Fujii et al.

(10) Patent No.: US 7,391,990 B2
(45) Date of Patent: Jun. 24, 2008

(54) WASTE DEVELOPER COLLECTING CONTAINER FOR COLOR IMAGE FORMING APPARATUS

(75) Inventors: Tomohiko Fujii, Yamatokooriyama (JP); Susumu Murakami, Souraku-gun (JP); Hideaki Kadowaki, Souraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 306 days.

(21) Appl. No.: 11/280,411

(22) Filed: Nov. 17, 2005

(65) Prior Publication Data

US 2006/0110195 A1 May 25, 2006

(30) Foreign Application Priority Data

Nov. 19, 2004 (JP) ..... 2004-335499

(51) Int. Cl.

| | |
|---|---|
| ***G03G 15/00*** | (2006.01) |
| ***G03G 15/01*** | (2006.01) |
| ***G03G 21/00*** | (2006.01) |
| ***G03G 21/12*** | (2006.01) |

(52) U.S. Cl. ..... 399/107; 399/110; 399/299; 399/358; 399/360

(58) Field of Classification Search ..... 399/107, 399/110, 111, 358, 360, 101, 299, 302
See application file for complete search history.

(56) References Cited

U.S. PATENT DOCUMENTS

| | | | | |
|---|---|---|---|---|
| 6,937,839 | B2 * | 8/2005 | Harumoto et al. | 399/360 |
| 6,975,830 | B2 * | 12/2005 | Murakami et al. | 399/358 |
| 7,245,868 | B2 * | 7/2007 | Arai | 399/360 |

FOREIGN PATENT DOCUMENTS

| | | | |
|---|---|---|---|
| JP | 2001-324905 | A | 11/2001 |
| JP | 2002-114503 | A | 1/2002 |
| JP | 2002-82505 | A | 3/2002 |
| JP | 2003-337515 | A | 11/2003 |

* cited by examiner

*Primary Examiner*—William J Royer
(74) *Attorney, Agent, or Firm*—Nixon & Vanderhye P.C.

(57) ABSTRACT

A color image forming apparatus includes: process printing units each having a photoreceptor drum; a transfer belt to which toner images are transferred; a transfer roller for transferring, as a whole, the toner images on the transfer belt to recording paper; a cleaning unit for collecting the remaining developers that have been left over on the photoreceptor drums and the transfer belt, is constructed such that a positioning sub-frame which is set with a developer collecting container for storing the collected developers and positions the process printing units relative to the housing, on one side of the apparatus body is removably attached to the housing.

24 Claims, 3 Drawing Sheets

WASTE DEVELOPER COLLECTING CONTAINER FOR COLOR IMAGE FORMING APPARATUS

This Nonprovisional application claims priority under 35 U.S.C. §119 (a) on Patent Application No. 2004-335499 filed in Japan on 19 Nov. 2004, the entire contents of which are hereby incorporated by reference.

BACKGROUND (1) Field of the Technology

The present technology relates to a color image forming apparatus and in particular relates to a color image forming apparatus, such as a copier, printer, facsimile machine or the like, which uses electrophotography as a process of image forming, wherein developer images formed on image bearing members are transferred to a printing medium.

(2) Description of the Prior Art

Recently, in the field of image forming apparatus, there is a common trend toward color configurations, and with the development of color image forming apparatus, an increased number of color image forming apparatus have become used.

In the field of color image forming apparatus, in order to make the apparatus compact and improve the speed of color printing, there have been proposed many kinds of color image forming apparatus using an indirect transfer process in which, by use of an intermediate transfer medium, color separations of image information developed by multiple process printing units are laid one over another on the intermediate transfer medium to form a lamination of developer images (primary transfer) and then the laminated developer images are transferred as a whole (secondary transfer) to recording paper that is conveyed, to thereby form a printed color image of information on the recording paper.

In order to create exact images, high-precision positioning is demanded for the multiple process printing units, intermediate transfer medium and the like of the color image forming apparatus. For this purpose, when the multiple process printing units, intermediate transfer member and the like, are mounted to the apparatus body, these components are generally or in previous practice, positioned with reference to the front and rear frames of the apparatus body.

However, the color image forming apparatus includes such components as the intermediate transfer medium and the like, which need maintenance at a fixed cycle and such components as developing units, which need replacement on demand because consumption of the developer from the developing unit in the color image forming apparatus differs depending on color.

Accordingly, in consideration of maintenance performance and workability, some measures have been contemplated such that the opening through which the developing units are attached is widened or the intermediate transfer medium and the developing units are constructed so that they can be positioned unit by unit relative to the apparatus frame. However, these manipulations exert influence on the strength of the apparatus frame and cause the problem of making the entire apparatus bulky due to increase in volume of each unit.

Under these circumstances, development of the positioning unit that positions and fixes the multiple process printing units, each including an image bearing member or photoreceptor drum, developing unit and the like, as a whole by arranging an openable/closable front cabinet in the body frame of the color image forming apparatus, has been made.

Generally, in the color image forming apparatus using the indirect transfer process, a transfer efficiency as high as 100% cannot be achieved in the primary transfer step in which the developer image is transferred from the photoreceptor drum of the process printing unit to the intermediate transfer medium and in the secondary transfer step in which the developer image is transferred from the intermediate transfer medium to recording paper. Usually, the transfer efficiency in this process roughly falls within a range from 80 to 95%.

For this reason, in order for the developers that have not been transferred from the photoreceptor drums to the intermediate transfer medium and remain on the photoreceptor drums and the developer that has not been transferred from the intermediate transfer medium to recording paper and remains on the intermediate transfer medium, not to exert influence on the next printing operation and degrade the printing quality, various configurations which are adapted to collect the developers left over on the photoreceptor drums and intermediate transfer medium have been proposed (c.f. Patent literature 1: Japanese Patent Application Laid-open 2001-324905, Patent literature 2: Japanese Patent Application Laid-open 2002-14503).

Usually, in the color image forming apparatus using an intermediate transfer medium, waste developer is generated at five places, specifically, on the photoreceptor drums of four colors, yellow, magenta, cyan and black, and on the intermediate transfer medium after secondary transfer, so that cleaning devices are provided for those places so as to collect waste developer.

However, in conventional cleaning devices, the developer conveying paths for conveying the collected leftover developers and the developer collecting container for storage, tend to become bulky, hence this causes the problem of the whole apparatus becoming large-sized.

Further, it is also necessary to provide complicated waste developer conveying paths for collecting these together, which not only enlarges the apparatus and complicates the apparatus configuration but also may cause the problem of the developer scattering inside the machine.

SUMMARY

The exemplary embodiment presented herein has been devised in view of the above conventional problems, it is therefore a feature of the exemplary embodiment to provide a color image forming apparatus which facilitates positioning of the process printing units and intermediate transfer medium and the like and which permits sharing of a developer collecting container for collection of waste developer, and is improved in work performance and maintenance performance in mounting the process printing units and the intermediate transfer medium.

In order to achieve the above feature, the color image forming apparatus according to the exemplary embodiment presented herein is configured as follows.

The color image forming apparatus according to the first aspect of the exemplary embodiment, includes: a plurality of image forming units, each having an image bearing member for supporting a developer image formed with a developer corresponding to a color in accordance with color-separated image information that is obtained by separating image information into plural color components and subjecting them to image processes; an intermediate transfer medium to which a multiple number of developer images are transferred in layers; a transfer means for transferring the developer images that have been transferred in layers on the intermediate transfer medium, all at once, to a print medium; and a developer collecting section for collecting, at least, the remaining developers that have not been transferred from the image bearing members to the intermediate transfer medium but have been left over on the image bearing members and the remaining developer that has not been transferred from the intermediate transfer medium to the print medium but has been left over on the intermediate transfer medium, and is characterized in that a positioning member which is set with a developer collecting container for storing the collected developers and positions at least the plural image forming units relative to an apparatus frame, is removably attached to the apparatus frame on one side of the apparatus body.

The color image forming apparatus according to the second aspect of the exemplary embodiment presented herein is characterized in that, in addition to the configuration described in the above first aspect, the developer collecting container is removably attached to the positioning member.

The color image forming apparatus according to the third aspect of the exemplary embodiment presented herein is characterized in that, in addition to the configuration described in the above first and second aspects, the positioning member has a multiple number of positioning holes for positioning one end side of the plural image forming units with respect to the main scan direction, and the developer collecting container is disposed under the positioning holes.

The color image forming apparatus according to the fourth aspect of the exemplary embodiment presented herein is characterized in that, in addition to the configuration described in the above first to third aspects, the developer collecting section includes screws for conveying and/or flattening the leftover developers collected from the multiple image forming units and the intermediate transfer medium, and the positioning member is formed with screw engagement holes that engage the screws.

The color image forming apparatus according to the fifth aspect of the exemplary embodiment presented herein is characterized in that, in addition to the configuration described in the above fourth aspect, developer passages for guiding the developers that have been conveyed to the screw holes into the developer collecting container are formed extending from the screw holes to the developer collecting container, in the positioning member.

The color image forming apparatus according to the sixth aspect of the exemplary embodiment presented herein is characterized in that, in addition to the configuration described in the above first to fifth aspects, the positioning member is constructed so as to pivot on one side edge relative to the apparatus body and will open and close with the other side edge rotated outwards of the apparatus body.

According to the first to sixth aspects of the exemplary embodiment, in a color image forming apparatus comprising: a plurality of image forming units, each having an image bearing member for supporting a developer image formed with a developer corresponding to a color in accordance with color-separated image information that is obtained by separating image information into plural color components and subjecting them to image processes; an intermediate transfer medium to which a multiple number of developer images are transferred in layers; a transfer means for transferring the developer images that have been transferred in layers on the intermediate transfer medium, all at once, to a print medium; and a developer collecting section for collecting, at least, the remaining developers that have not been transferred from the image bearing members to the intermediate transfer medium but have been left over on the image bearing members and the remaining developer that has not been transferred from the intermediate transfer medium to the print medium but has been left over on the intermediate transfer medium, a positioning member which positions at least the plural image forming units relative to an apparatus frame, is arranged on one side of the apparatus body. This configuration therefore makes positioning of the process printing units and the intermediate transfer medium easy and also makes the positioning member provide the function of reinforcement of the apparatus frame so as to increase the rigidity of the apparatus frame.

Since the arrangement of the developer collecting container in the positioning member makes it possible to put the leftover developers (waste developer) collected from the different process printing units and the intermediate transfer medium, together to one side, it is possible to use one common developer collecting container.

Further, removable attachment of the positioning member to the apparatus frame makes it possible to improve the workability and maintenance performance when the process printing units and the intermediate transfer medium are set in place.

In addition to the above common effects obtained from the first to sixth aspects of the exemplary embodiment, the following effects can be obtained from each aspect of the exemplary embodiment.

Detailedly, according to the second aspect of the exemplary embodiment presented herein, removable attachment of the developer collecting container to the positioning member makes it possible for the operator to readily implement maintenance of the process printing units and intermediate transfer medium as well as readily perform replacement and maintenance of the developer collecting container, from one side of the apparatus body.

According to the third aspect of the exemplary embodiment, since the positioning member is formed with a multiple number of positioning holes for positioning one end side of the plural image forming units with respect to the main scan direction, it is possible to readily position the image forming units. Further, since the developer collecting container is disposed under these positioning holes, it is possible to simplify the structure of the conveyor passages of waste developer from the image forming unit's side toward the developer collecting container and the collected waste developer can be easily put together at one place.

According to the fourth aspect of the exemplary embodiment, since the developer collecting portion includes screws for conveying and/or flattening the leftover developers collected from the multiple image forming units and the intermediate transfer medium, this arrangement makes it possible to easily collect leftover developers to one side of the apparatus body. Further, since the positioning member is formed with screw engagement holes that engage the screws, it is possible to readily position the screws and facilitate secure engagement of the screws with the positioning member. As a result, it is possible to collect the thus conveyed waste developer into the developer collecting container without scattering the developer inside the machine.

According to the fifth aspect of the exemplary embodiment, since developer passages for guiding the developers that have been conveyed to the screw holes into the developer collecting container are formed extending from the screw holes to the developer collecting container, in the positioning member, collection of the collected leftover developers into the developer collecting container can be done by use of simple paths.

According to the sixth aspect of the exemplary embodiment, since the positioning member is constructed so as to pivot on one side edge relative to the apparatus body and will open and close with the other side edge rotated outwards from the apparatus body, this configuration makes it possible to facilitate the positioning member to open and close without separating it from the apparatus body, thus making it easy to implement mounting and maintaining operations of the image forming units, intermediate transfer medium, developer collecting container and the like.

DESCRIPTION OF THE PREFERRED EMBODIMENTS

The best mode for carrying out an exemplary embodiment presented herein will hereinafter be described with reference to the drawings.

Figure 1:
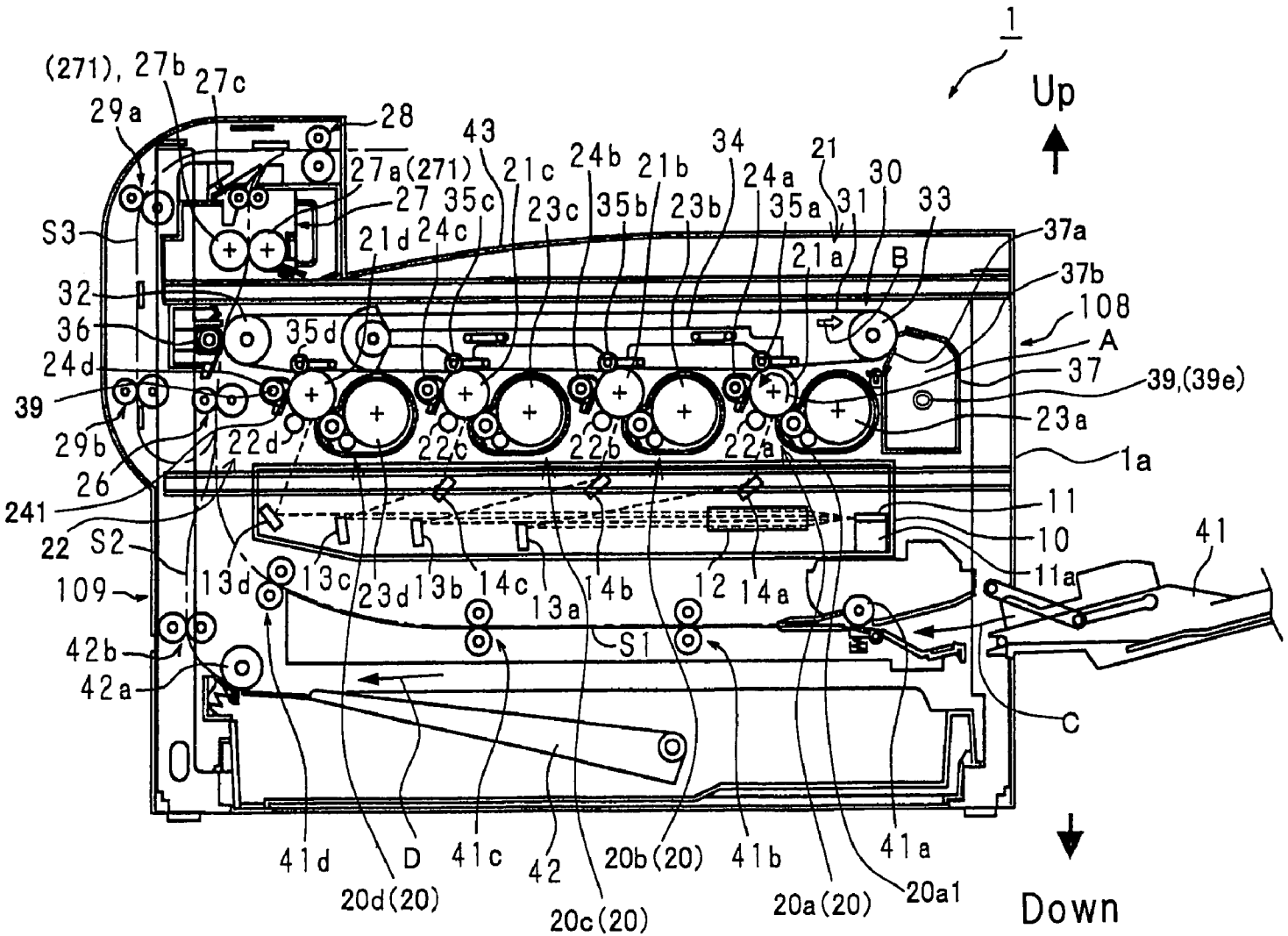
FIG. 1 is an illustrative view (sectional view from the rear) showing an overall configuration of a color image forming apparatus according to embodiment.
Figure 2:
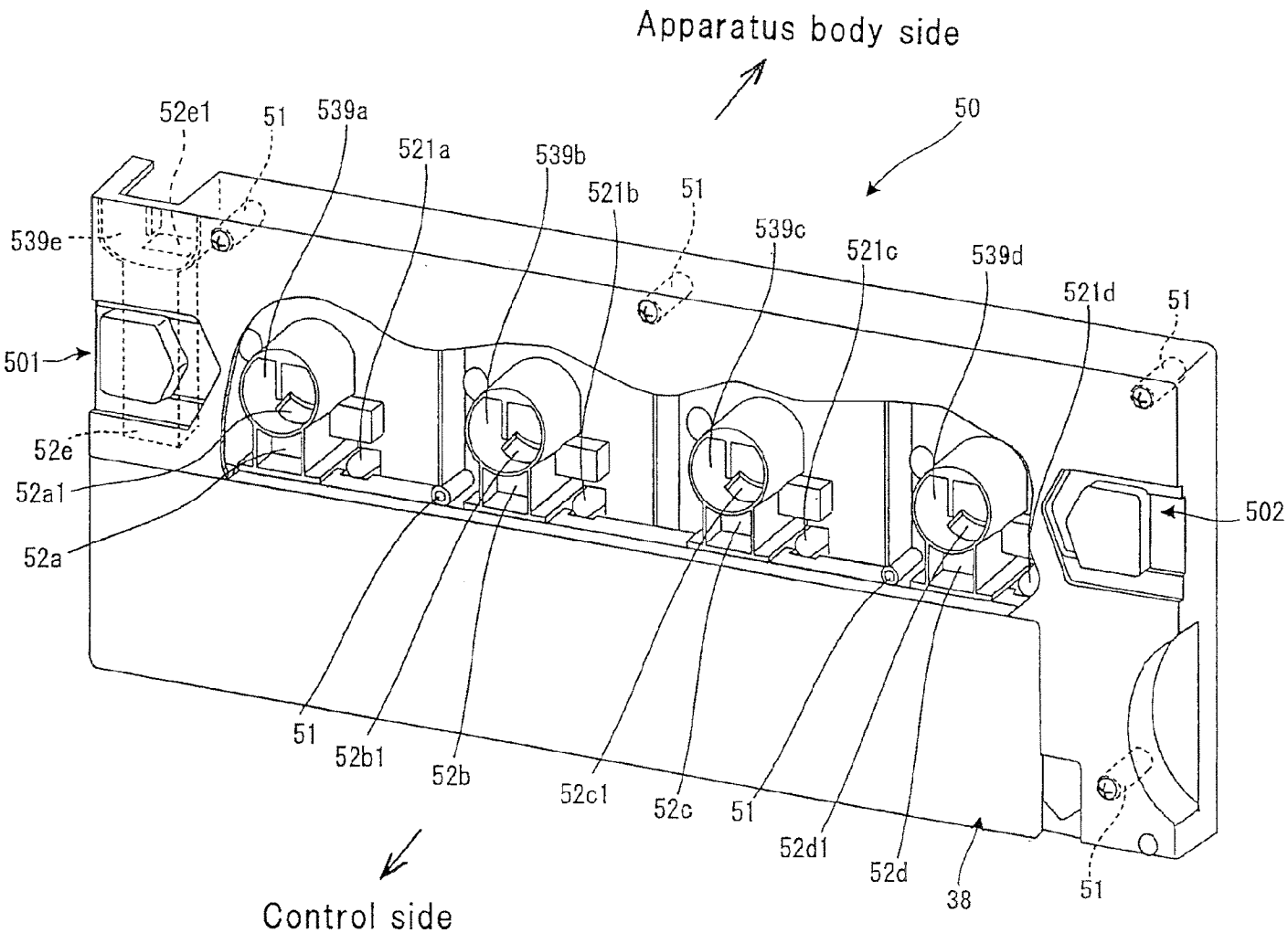
FIG. 2 is an illustrative view showing a configuration of a positioning sub-frame and a waste toner collecting container of the color image forming apparatus.

FIG. 1 shows one example of an exemplary embodiment and is an illustrative view (sectional view from the rear) showing the overall configuration of a color image forming apparatus according to one exemplary embodiment; FIG. 2 is an illustrative view showing a configuration of a positioning sub-frame and a waste toner collecting container of the color image forming apparatus; and FIG. 3 is a horizontal sectional view showing a state where the positioning sub-frame and the process printing units are positioned.

Figure 3:
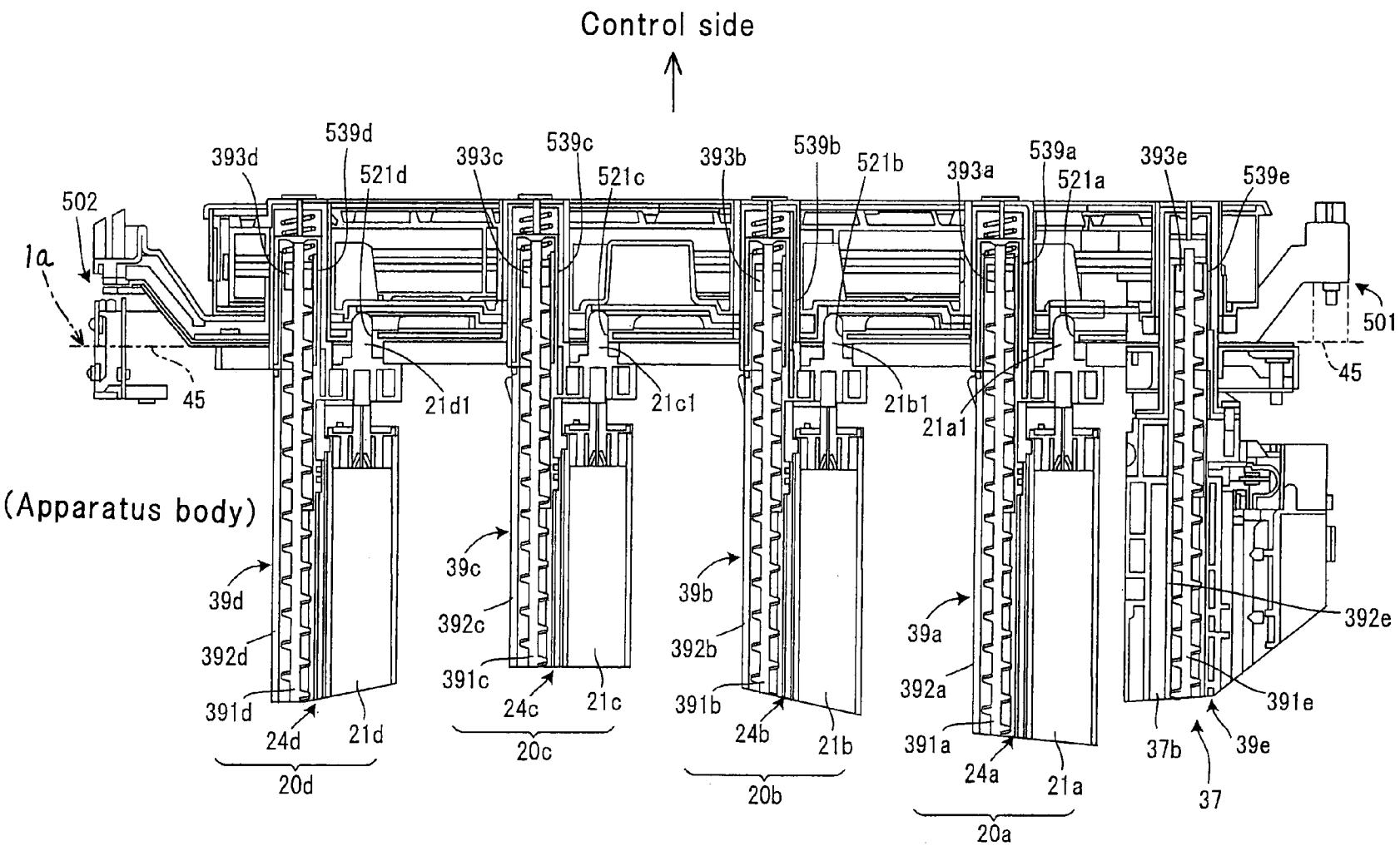
FIG. 3 is a horizontal sectional view showing a state where the positioning sub-frame and the process printing units are positioned.

As shown in FIGS. 1 to 3, a color image forming apparatus 1 of the present embodiment includes: a plurality of image forming units or namely, process printing units 20 (20*a*, 20*b*, 20*c* and 20*d*) each having a photoreceptor drum 21 (21*a*, 21*b*, 21*c* or 21*d*) for supporting a developer image (which will be referred to as "toner image" hereinbelow) formed with a developer (which will be referred to as "toner" hereinbelow) corresponding to the color of color-separated image information; a transfer belt 31 or an intermediate transfer medium, to which a multiple number of toner images are transferred in layers; and a transfer roller 36 constituting a transfer means for transferring the toner images that have been transferred in layers on the transfer belt 31, all at once, to recording paper as a print medium; and photoreceptor cleaning units 24*a*, 24*b*, 24*c* and 24*d* and a transfer belt cleaning unit 37 constituting a developer collecting section for collecting the leftover toners (waste toner) that have not been transferred from photoreceptor drums 21 to transfer belt 31 and remain on the photoreceptor drums 21 and the leftover toner (waste toner) that has not been transferred from transfer belt 31 to recording paper and remains on transfer belt 31, and is characterized in that a positioning sub-frame 50 as to be a positioning member is arranged on one side of the apparatus body and removably attached to the apparatus frame, namely, housing 1*a*, and the positioning sub-frame 50 is so constructed as to position the multiple process printing units 20 relative to the housing 1*a* and also enable a waste toner collecting container 38 for storing the collected waste toners as a whole, to fit therewith.

Here, concerning the positional relationship between the color image forming apparatus 1 of the embodiment and the operator, the operator is supposed to stand at the far side of the color image forming apparatus 1 shown in FIG. 1. In other words, the control side is located on the unillustrated side of color image forming apparatus 1, and the left and right sides of FIG. 1, as viewed, are the reverse of those when the operator faces the control side.

In the following description, the front side (F-side) refers to the operator side and the rear side (R-side) refers to the backside of color image forming apparatus 1, or the side shown by FIG. 1.

To begin with, the overall configuration of color image forming apparatus 1 will be described.

As shown in FIG. 1, color image forming apparatus 1 according to the present embodiment is a so-called digital color printer which is adapted to output a color image by separating color image information into images of individual colors, is mainly composed of an image forming portion 108 and a paper feed portion 109, and forms multi-color images or monochrome images on recording paper in accordance with a print job sent from an information processor (not illustrated) such as a personal computer and the like, externally connected.

Image forming portion 108 forms multi-color images based on electrophotography with yellow (Y), magenta (M), cyan (C) and black (K) colors. This image forming portion 108 is mainly composed of an exposure unit 10, process printing units 20 as image forming units, a fixing unit 27, a transfer belt unit 30 having a transfer belt 31 and a transfer belt cleaning unit 37 for cleaning transfer belt 31.

Describing the overall arrangement of image forming portion 108, fixing unit 27 is disposed on the top at one end side of housing 1*a* of color image forming apparatus 1, transfer belt unit 30 is extended under the fixing unit 27 from the one end side to the other end side of housing 1*a*, process printing units 20 are disposed under the transfer belt unit 30, and exposure unit 10 is disposed under the process printing units 20.

Further, transfer belt cleaning unit 37 is arranged on the other side end of transfer belt unit 30. Also, a paper output tray 43 is arranged contiguous to fixing unit 27, over image forming portion 108.

Paper feed portion 109 is arranged under the image forming portion 108.

In the present embodiment, as process printing units 20, four process printing units 20*a*, 20*b*, 20*c* and 20*d*, corresponding to individual colors, i.e., black (K), yellow (Y), magenta (M) and cyan (C), are arranged successively along transfer belt 31.

The process printing unit 20*a* for the color whose toner image, among all the toner images to be transferred to transfer belt 31, is transferred to transfer belt 31 first, or in other words, the process printing unit 20*a* which is located at a position most distant from transfer roller 36, holds a toner of black color so as to form a black toner image first on transfer belt 31.

These process printing units 20*a*, 20*b*, 20*c* and 20*d* are arranged in parallel to each other, in the approximately horizontal direction (in the left-to-right direction in the drawing) in housing 1*a*, and include respective photoreceptor drums 21 (21*a*, 21*b*, 21*c* and 21*d*) as the image bearing member for each individual associated color, respective charging devices 22 (22*a*, 22*b*, 22*c* and 22*d*) for charging the photoreceptor drums 21*a*, 21*b*, 21*c* and 21*d*, respective photoreceptor developing devices 23*a*, 23*b*, 23*c* and 23*d* and respective cleaning units 24*a*, 24*b*, 24*c* and 24*d* and other components.

Here, the symbol a, b, c, and d are added to the constituents so as to show correspondence to black (K), yellow (Y), magenta (M) and cyan (C), respectively. In the description hereinbelow, however, the constituents provided for each color are generally referred to as photoreceptor drum 21, charging device 22, developing device 23, and photoreceptor cleaning unit 24, except in the case where a constituent corresponding to a specific color needs to be specified.

Photoreceptor drum 21 is arranged so that part of its outer peripheral surface comes into contact with the surface of transfer belt 31 while charging device 22 as an electric field generator, developing device 23 and photoreceptor cleaning unit 24 are arranged along, and close to, the outer peripheral surface of the photoreceptor drum 21.

As charging device 22, a roller type charger is used and arranged, at a position on the approximately opposite side across photoreceptor drum 21, from transfer belt unit 30, and in contact with the outer peripheral surface of photoreceptor drum 21. Though in the present embodiment a roller type charger is used as charging device 22, a brush type charger, discharging type charger or the like may be used in place of the roller type charger.

Developing device 23 for each color holds a corresponding toner of black (K), yellow (Y), magenta (M) or cyan (C) color and is arranged on the downstream side of charging device 22 with respect to the rotational direction of the photoreceptor drum (in the direction of arrow A in the drawing), so that the toner of each color is supplied to the electrostatic latent image formed on the peripheral surface of the photoreceptor drum 21 to produce a visual image.

Photoreceptor cleaning unit 24 is arranged on the upstream side of charging device 22 with respect to the rotational direction A of the photoreceptor drum 21. Photoreceptor cleaning unit 24 has a cleaning blade 241 and is configured so that the cleaning blade 241 is positioned in abutment with the outer peripheral surface of photoreceptor drum 21 so as to scrape and collect leftover toner off the photoreceptor drum 21. A reference numeral 39 in the drawing designates a screw for conveying collected toner.

Exposure unit 10 is to create an electrostatic latent image by radiating a laser beam onto the surface of every photoreceptor drum 21 of individual color in accordance with the image data for printing, and is mainly composed of a laser scanning unit (LSU) 11 having a laser illuminator 1*a*, a polygon mirror 12 and reflection mirrors 13*a*, 13*b*, 13*c*, 13*d*, 14*a*, 14*b* and 14*c* for reflecting the laser beam for individual colors.

The laser beam emitted from laser illuminator 11*a* is separated into components for different colors, by polygon mirror 12, so that the separated components of light are reflected by respective reflection mirrors 13*a* to 13*d* and 14*a* to 14*c* to illuminate the corresponding photoreceptor drums 21 of every color.

Here, concerning laser scanning unit 11, a writing head made up of an array of light emitting elements such as EL (electro luminescence), LED (light emitting diode) and others, may also be used instead of laser illuminator 11*a*.

Transfer belt unit 30 provides the function of forming a color toner image (multi-color toner image) on the transfer belt 31 by successively transferring the toner images of different colors formed on photoreceptor drums 21 to the transfer belt 31, one over another.

Transfer belt unit 30 is mainly composed of transfer belt 31, a transfer belt drive roller 32, a transfer belt driven roller 33, a transfer belt tension mechanism 34 and intermediate transfer rollers 35*a*, 35*b*, 35*c* and 35*d*.

In the following description, any of the intermediate transfer rollers 35*a*, 35*b*, 35*c* and 35*d* will be referred to as intermediate transfer roller 35 when general mention is made.

Transfer belt 31 is formed of an endless film of about 75 μm to 120 μm thick. Transfer belt 31 is made from polyimide, polycarbonate or the like.

Also, transfer belt 31 is tensioned by transfer belt drive roller 32, transfer belt driven roller 33, transfer belt tension mechanism 34 and intermediate transfer rollers 35 so that its surface comes into contact with the outer peripheral surfaces of photoreceptor drums 21, and is adapted to move in the auxiliary scan direction (in the direction of arrow B in the drawing) by a driving force of the transfer belt drive roller 32.

Transfer belt drive roller 32 is disposed at one end side of housing 1*a*, and is wound with transfer belt 31 so as to drive the transfer belt 31 by applying a driving force whilst nipping and pressing the transfer belt 31 and a recording sheet together between itself and transfer roller 36 to convey the recording sheet.

Transfer belt driven roller 33 is disposed on the other end side of housing 1*a*, so as to suspend and tension the transfer belt 31 approximately horizontally from the one end side to the other end side of housing 1*a*, in cooperation with transfer belt drive roller 32.

Intermediate transfer rollers 35 are arranged in the interior space of transfer belt 31 wound between transfer belt drive roller 32 and transfer belt driven roller 33 so as to abut the inner surface of transfer belt 31 and press its outer peripheral surface against the outer peripheral surfaces of the photoreceptor drums 21.

Further, intermediate transfer roller 35 are formed of a metal (e.g., stainless steel) shaft having a diameter of 8 to 10 mm and a conductive elastic material such as EPDM, foamed urethane and the like, coated on the outer peripheral surface of the metal shaft.

Each of the thus formed intermediate transfer rollers 35 is applied with a high-voltage transfer bias for transferring the toner image formed on photoreceptor drum 21 to transfer belt 31, i.e., a high voltage of a polarity (+) opposite to the polarity (−) of the electrostatic charge on the toner, so as to apply a uniform high voltage from the elastic material to transfer belt 31.

The visualized toner images (electrostatic images) formed on the photoreceptor drums 21 corresponding to every color are transferred one over another on transfer belt 31, reproducing the image information input to the apparatus. The thus formed laminated image information is transferred to recording paper by transfer roller 36 disposed at the contact point of transfer belt 31 with the recording paper.

Transfer roller 36 as a constituent of the transfer means is arranged opposing transfer belt drive roller 32 at approximately the same level and in parallel thereto and pressing against the transfer belt 31 wound on the transfer belt drive roller 32, forming a predetermined nip therewith while being applied with a high voltage of a polarity (+) opposite to the polarity (−) of the static charge on the toner, for transferring the multi-color toner image formed on the transfer belt 31 to the recording paper.

In order to produce a constant nip between transfer belt 31 and transfer roller 36, either transfer belt drive roller 32 or transfer roller 36 is formed of a hard material such as metal or the like while the other roller is formed of a soft material such as elastic rubber, foamed resin, and the like.

A registration roller 26 is provided under transfer belt drive roller 32 and transfer roller 36. This registration roller 26 is configured so as to set the front end of a recording sheet fed from paper feed portion 109 in register with the leading end of the toner image on transfer belt 31 and deliver the sheet toward the transfer roller side.

Since the toner adhering to transfer belt 31 as the belt comes in contact with photoreceptor drums 21, or the toner which has not been transferred to recording paper by transfer roller 36 and remains on transfer belt 31, would cause contamination of color toners at the next operation, it is removed and collected by transfer belt cleaning unit 37.

Transfer belt cleaning unit 37 includes: a cleaning blade 37*a*, as a cleaning element, located near transfer belt driven roller 33 and arranged so as to abut (come into sliding contact with) transfer belt 31; a box-like toner collector 37*b* for temporarily holding toner (waste toner), left over on and scraped from transfer belt 31 by the cleaning blade 37*a*; and a screw or toner conveying device 39 of a screw type for sending waste toner from toner collector 37*b* to waste toner collecting container 38.

Also, transfer belt cleaning unit 37 is located near process printing unit 20*a*, on the upstream side of the process printing unit 20*a* with respect to the moving direction of transfer belt 31. Further, transfer belt 31 is supported from its interior side by transfer belt driven roller 33, at the portion where cleaning blade 37*a* comes into contact with the outer surface of transfer belt 31.

Fixing unit 27 includes: as shown in FIG. 1, paired fixing rollers 271 consisting of a heat roller 27*a* and a pressing roller 27*b*; and a conveying roller 27*c* above the fixing rollers 271. A recording sheet is input from below fixing rollers 271 and output to above conveying roller 27*c*.

A paper discharge roller 28 is arranged above fixing unit 27, so that the recording sheet conveyed from conveying roller 27*c* is discharged by the paper discharge roller 28 onto paper output tray 43.

Referring to the fixing of a toner image by fixing unit 27, a heating device (not shown) such as a heater lamp or the like, provided inside or close to heat roller 27*a* is controlled based on the detected value from a temperature detector (not shown) so as to keep the heat roller 27*a* at a predetermined temperature (fixing temperature) while the recording sheet with a toner image transferred thereon is heated and pressed between heat roller 27*a* and pressing roller 27*b* as it is being conveyed and rolled, so that the toner image is thermally fused onto the recording sheet.

A duplex printing paper path S3 for double-sided printing is constructed adjacent to fixing unit 27, from the rear of fixing unit 27 downward to the vicinity of paper feed portion 109. The recording sheet is inverted by conveying rollers 29*a* and 29*b* which are arranged at the top and bottom and along the duplex printing paper path S3, and delivered again toward transfer roller 36.

Specifically, conveying roller 29*a* is disposed at the rear of fixing unit 27 and conveying roller 29*b* is located below conveying roller 29*a* with respect to the top and bottom direction and at approximately the same level as registration roller 26.

Next, the configurations of positioning sub-frame 50 and waste toner collecting container 38 will be described in detail with reference to the drawings.

As shown in FIGS. 2 and 3, positioning sub-frame 50 has a transversally elongated box-like configuration in the side-to-side direction of image forming apparatus 1 and is disposed along the parallel arranged multiple process printing units 20 and transfer belt 31 and mounted to housing 1*a* from the far side (control side) of image forming apparatus 1, when viewed in FIG. 1.

This positioning sub-frame 50 has a pair of positioning structures 501 and 502 for positioning itself to housing la of the apparatus body, formed at both extremes, with respect to the side-to-side direction thereof. These positioning structures 501 and 502 provide a supporting function for easy handling when positioning sub-frame 50 is mounted to housing 1*a*.

Positioning sub-frame 50 is positioned to housing 1*a*, as shown in FIG. 3, to an attachment face 45 of housing 1*a*, by use of positioning structures 501 and 502. Specific measures for positioning can be done by providing projective positioning elements such as positioning pins, blocks, wedge-like fitting pieces and the like, on the positioning sub-frame side, forming engaging elements for receiving the positioning elements on the housing side and mating one with the other so as to position them with respect to the vertical and horizontal directions.

Further, waste toner collecting container 38 having a box-shape elongated in the side-to-side direction of the apparatus is removably attached to the interior bottom of positioning sub-frame 50 (on its apparatus body side), as shown in FIG. 2.

Positioning sub-frame 50 has a multiple number of attachment bosses 51 for fixing itself to housing 1*a* with fasteners such as screws, bolts, and the like, formed at the corners and along side edges thereof.

Positioning sub-frame 50 also has drum shaft bearing holes 521*a* to 521*d* formed at the positions opposing, respectively, the corresponding ends of attachment shafts 21*a*1 to 21*d*1 of photoreceptor drums 21*a* to 21*d* in process printing units 20*a* to 20*d* so as to support and engage these ends.

Positioning sub-frame 50 further has toner collecting ports 539*a* to 539*e* formed at the positions opposing, respectively, the corresponding ends of toner conveying devices 39*a* to 39*d* of process printing units 20*a* to 20*d* and toner conveying device 39*e* of transfer belt cleaning unit 37 so as to engage these ends.

At the bottom of toner collecting ports 539*a* to 539*e*, waster toner passages 52*a* to 52*e* that communicate with respective toner collecting ports 539*a* to 359*e* are formed with their lower ends opposing waste toner collecting container 38 located below. Reference numerals 52*a* l to 52*e* l designate openings of waste toner passages 52*a* to 52*e*, respectively.

In the above arrangement, photoreceptor drums 21*a* to 21*d* and toner conveying devices 39*a* to 39*e* are positioned to positioning sub-frame 50 by means of the aforementioned drum shaft bearing holes 521*a* to 521*d* and toner collecting ports 539*a* to 539*d*.

Each of toner conveying device 39*a* to 39*e* includes a cylindrical toner conveyor case 392*a* to 392*e* and a screw 391*a* to 391*e* having a continuous spiral vane formed on the outer periphery of its rotational axis, incorporated in cylindrical conveyor case 392*a* to 392*e*.

In this arrangement, as screw 391*a* to 391*e* is turned by an unillustrated driving source, the waste toner residing between the spiral vane of screw 391*a* to 391*e* and the interior wall surface of toner conveyor case 392*a* to 392*e* is moved in a direction away from photoreceptor drum 21*a* to 21*d* or toner collector 37*b* and brought toward positioning sub-frame 50 and fed into waste toner collecting container 38 arranged in the positioning sub-frame 50.

Of the aforementioned toner conveying devices 39*a* to 39*e*, for toner conveying devices 39*a* to 39*d* for photoreceptor cleaning units 24*a* to 24*d*, an unillustrated opening is formed in each toner conveyor case 392*a* to 392*d* so that waste toner scraped from photoreceptor drum 21*a* to 21*d* by cleaning blade 241 is input therethrough.

Also, for the conveying device 39*e* provided for transfer belt cleaning unit 37, an unillustrated opening is formed in toner conveyor case 392*e* so that waste toner once stored in toner collector 37*b* is input therethrough.

Each toner conveying device 39*a* to 39*e* is constructed so that it projects to the front side of color image forming apparatus 1 beyond the attachment face 45 of positioning sub-frame 50 in housing 1*a*. When positioning sub-frame 50 is mounted to color image forming apparatus 1, the positioning sub-frame 50 is positioned with each of the projected portions inserted through corresponding toner collecting port 539*a* to 539*e* into positioning sub-frame 50.

Further, in each of toner conveying devices 39*a* to 39*e*, a discharge hole 393*a* to 393*e* which communicates with waste toner passage 52*a* to 52*e* and allows waste toner to drop into waste toner collecting container 38, is formed on the bottom side of the projected portion of toner conveyor case 392*a* to 392*e*, which is inserted into toner collecting port 539*a* to 539*e* of positioning sub-frame 50.

In waste toner collecting container 38, openings (not shown) are formed at positions opposing waste toner passages 52*a* to 52*e* that are connected to toner collecting ports 539*a* to 539*e* of positioning sub-frame 50, so that waste toner can pass through these openings and be collected and stored in waste toner collecting container 38.

Next, the configuration of paper feed portion 109 will be described.

Paper feed portion 109 includes a manual feed tray 41 and a paper feed cassette 42 for holding recording sheets to be used for image forming, and is adapted to deliver recording sheets, one by one, from manual feed tray 41 or paper feed cassette 42 to image forming portion 108.

As shown in FIG. 1, manual feed tray 41 is arranged at one side end (on the right side in the drawing) of housing 1*a* of color image forming apparatus 1 so that it can be unfolded outside when used and folded up to the one end side when unused. The manual feed tray 41 delivers paper, one by one, into the housing 1*a* of color image forming apparatus 1 when the user places a few recording sheets (necessary number of sheets) of a desired type.

Arranged on the downstream side with respect to the paper feed direction (the direction of arrow C in the drawing) of recording sheets by manual feed tray 41, inside housing 1*a* of color image forming apparatus 1, is a pickup roller 41*a* below exposure unit 10. Conveying rollers 41*b*, 41*c* and 41*d* are also disposed at approximately the same level along the path downstream with respect to the paper feed direction C.

Pickup roller 41*a* touches one edge part of the surface of the recording sheet that is fed from manual feed tray 41 and reliably conveys the paper, sheet by sheet, by the function of the roller's frictional resistance.

Conveying rollers 41*d* located on the most downstream side are positioned above conveying rollers 41*b* and 41*c*, so as to convey recording sheets upward.

The aforementioned pickup roller 41*a* and conveying rollers 41*b*, 41*c* and 41*d* constitute a recording paper conveying path S1.

On the other hand, paper feed cassette 42 is arranged under the image forming portion 108 and exposure unit 10 in housing 1*a*, so as to accommodate a large amount of recording sheets of a size specified by the specification of the apparatus or of a size that is determined beforehand by the user.

Arranged above one end side (the left-hand side in the drawing) of paper feed cassette 42 is a pickup roller 42*a*. Conveying rollers 42*b* are also provided obliquely above and on the downstream side of the pickup roller 42*a* with respect to the recording paper feed direction (the direction of arrow D in the drawing).

Pickup roller 42*a* picks up one edge of the surface of the topmost recording sheet of a stack of recording paper on paper feed cassette 42 and reliably feeds the paper, sheet by sheet, by the function of roller's frictional resistance.

Conveying rollers 42*b* convey the recording sheet delivered from pickup roller 42*a* upward along a recording sheet feed path S2 formed on one end side inside housing 1*a* to image forming portion 108.

Next, image output by color image forming apparatus 1 in the present embodiment will be described.

Color image forming apparatus 1 is constructed so as to transfer the toner images formed on photoreceptor drums 21 to a recording sheet fed from paper feed portion 109 by a so-called intermediate transfer process, or via transfer belt unit 30.

First, charging devices 22 uniformly electrify the outer peripheral surface of photoreceptor drums 21 at a predetermined voltage.

The electrified photoreceptor drums 21 are irradiated with a laser beam from exposure unit 10, so that an electrostatic latent image for every color is formed on each color's photoreceptor drum 21.

Then, toner is supplied from developing device 23 to the outer peripheral surface of photoreceptor drum 21 so that the electrostatic latent image formed on the outer peripheral surface of photoreceptor drum 21 is visualized with toner (to be a toner image).

The toner images formed on photoreceptor drums 21 are transferred to transfer belt 31.

Transfer of the toner images from photoreceptor drums 21 to transfer belt 31 is done by intermediate transfer roller 35 arranged in contact with the interior side of transfer belt 31.

As intermediate transfer rollers 35 are applied with a high voltage of a polarity (+) opposite to that of the polarity (−) of the electrostatic charge on the toner, transfer belt 31 has a high potential uniformly applied by the intermediate transfer roller 35, and presents the opposite polarity (+). By this arrangement, the toner image bearing negative (−) charge, on photoreceptor drums 21 are transferred to transfer belt 31 as the photoreceptor drums 21 turn and come into contact with transfer belt 31.

The toner images of colors formed on respective photoreceptor drums 21 are transferred to transfer belt 31 as photoreceptor drums 21 turn and come into contact with the moving transfer belt, and overlaid one over another, thus a color toner image is formed on transfer belt 31.

In this way, the toner images developed from electrostatic latent images on photoreceptor drums 21 for every color, are laminated on transfer belt 31 so that the image for printing is reproduced as a multi-color toner image on transfer belt 31.

Then, as transfer belt 31 moves and reaches the position where the recording sheet and the transfer belt 31 meet, the multi-color toner image on transfer belt 31 is transferred from transfer belt 31 to the recording sheet by the function of transfer roller 36.

Since the toner adhering to transfer belt 31 as the belt comes in contact with photoreceptor drums 21, or the toner which has not been transferred to the recording sheet by transfer roller 36 and remains on transfer belt 31, would cause color contamination of toners at the next operation, it is removed and collected by transfer belt cleaning unit 37.

Next, the operation of feeding recording paper by paper feed portion 109 will be described.

When recording paper placed on manual feed tray 41 is used, the recording paper is taken in by pickup roller 41*a* from manual feed tray 41, sheet by sheet, at controlled timings in accordance with the instructions from the control panel (not shown), and fed into the machine.

The recording sheet thus taken into the machine is conveyed along recording paper feed path S1 by conveying rollers 41*b*, 41*c* and 41*d* to image forming portion 108.

When the recording paper accommodated in paper feed cassette 42 is used, the paper is separated and fed from paper feed cassette 42, sheet by sheet, by pickup roller 42*a*, and conveyed by conveying rollers 42*b* along recording paper feed path S2 to image forming portion 108.

The recording sheet conveyed from manual feed tray 41 or paper feed cassette 42 is delivered to the transfer roller side, by registration roller 26, at such a timing as to bring the front end of the recording sheet in register with the leading end of the toner image on transfer belt 31, so that the toner image on transfer belt 31 is transferred to the recording sheet.

The recording sheet with a toner image formed thereon is further conveyed approximately vertically and reaches fixing unit 27, where the toner image is thermally fixed to the recording sheet by heat roller 27*a* and pressing roller 27*b*.

The recording sheet having passed through fixing unit 27, is discharged by discharge roller 28 when one-sided printing is selected, and placed face down on paper output tray 43.

In contrast, when double-sided printing is selected, the recording sheet is stopped and nipped by paper discharge roller 28, then the paper discharge roller 28 is rotated in reverse so that the recording sheet is guided to duplex printing paper path S3 and conveyed again to registration roller 26 by conveying rollers 29*a* and 29*b*.

By this movement, the printing face of the recording sheet is inverted and the direction of conveyance is reversed.

Illustratively, the leading edge of the sheet at the first printing is directed to the trailing end when the underside is to be printed, or the trailing edge of the sheet at the first printing is directed to the leading end when the underside is to be printed.

After the toner image is transferred and thermally fixed to the underside of the recording sheet, the sheet is discharged to paper output tray 43 by paper discharge roller 28.

Thus, the transfer operation to the recording sheet is done as described above.

Next, collection of the leftover toner that has not been transferred and remains on photoreceptor drums 21 and transfer belt 31 after the transfer process of color image forming apparatus 1 will be described.

To begin with, the toners that have not been transferred to transfer belt 31 and remain on photoreceptor drums 21*a* to 21*d* at the primary transfer in which the toner images from photoreceptor drums 21*a* to 21*d* are transferred to transfer belt 31 so as to form a laminated toner image, are scraped by cleaning blades 241 of photoreceptor cleaning units 24*a* to 24*d* and collected in photoreceptor cleaning units 24*a* to 24*d*.

The leftover toners collected in photoreceptor cleaning units 24*a* to 24*d* are conveyed and/or flattened as waste toner from photoreceptor cleaning units 24*a* to 24*d* to positioning sub-frame 50 by means of toner conveying devices 39*a* to 39*d*.

The waste toner arriving at positioning sub-frame 50, passing through toner collecting port 539*a* to 539*d* of positioning sub-frame 50, is collected into waste toner collecting container 38 located below.

On the other hand, the toner that has not been transferred to recording paper and has been left over on transfer belt 31 upon the secondary transfer where the toner images having transferred to transfer belt 31 are to be transferred together to recording paper, is scraped off by cleaning blade 37*a* of transfer belt cleaning unit 37 and collected into transfer belt cleaning unit 37.

The leftover toner collected in transfer belt cleaning unit 37 is conveyed and/or flattened as waste toner from transfer belt cleaning unit 37 to positioning sub-frame 50 by means of toner conveying device 39*e*.

The waste toner arriving at positioning sub-frame 50, passing through toner collecting port 539*e* of positioning sub-frame 50 and waste toner passage 52*e*, is collected into waste toner collecting container 38 located below.

In this way, the leftover toners remaining on photoreceptor drums 21*a* to 21*d* and transfer belt 31 are collected as a whole in waste toner collecting container 38 provided in positioning sub-frame 50.

When waste toner collecting container 38 has become full of waste toner, the front cover (not shown) is opened from the apparatus body so as to expose positioning sub-frame 50 with waste toner collecting container 38. Then, only the waste toner collecting container 38 is taken out from positioning sub-frame 50 so that the waste toner may be disposed of from waste toner collecting container 38 or the container may be replaced with a new empty waste toner collecting container 38.

According to the thus configured embodiment, since positioning sub-frame 50 is removably provided on one side (on the front side) of housing 1*a* that constitutes the apparatus frame of color image forming apparatus 1, it is possible to readily perform the positioning of photoreceptor drums 21*a* to 21*d*. Thus, this arrangement makes it possible to improve workability in the attachment work of process printing units 20*a* to 20*d* and the maintenance work of photoreceptor drums 21*a* to 21*d*.

Further, since positioning sub-frame 50 is formed in a box-shaped configuration, fixing of this positioning sub-frame 50 to housing 1*a* provides the function of reinforcement to improve the rigidity of housing 1*a*. As a result it is possible to assure reliable attachment of process printing units 20*a* to 20*d*, hence improving printing quality.

Moreover, according to the present embodiment, since waste toner collecting container 38 is arranged separately inside positioning sub-frame 50, or since the waste toner collecting container 38 is arranged not in the interior of the apparatus body but on one side of housing 1*a* of the apparatus body, it is possible to avoid contamination of the apparatus interior with waste toner. Further, since waste toner collecting container 38 can be easily attached and removed, it is possible to readily collect waste toner without getting the operator's hands dirty.

Still more, according to the present embodiment, since waste toner collecting container 38 is disposed under the toner collecting ports 539*a* to 539*e* formed in positioning sub-frame 50, it is possible to simplify the configuration of waste toner passages 52*a* to 52*e* for guiding waste toner from toner collecting ports 539*a* to 539*e* to waste toner collecting container 38 hence achieving easy collection of waste toner.

Though in this embodiment, positioning sub-frame 50 is removably fixed to housing 1*a* by fasteners, the present invention should not be limited to this attachment method of the positioning sub-frame 50. For example, positioning sub-frame 50 may be attached so that the sub-frame is able to pivot relative to the apparatus body at its bottom side and will open and close with the top side rotated outwards of the apparatus body.

This configuration makes it possible to cause positioning sub-frame 50 to open and close without separating it from the apparatus body, hence further facilitating mounting and maintenance work of process printing units 20, transfer belt 31, waste toner collecting container 38, and the like.

Further, in the present embodiment, though positioning sub-frame 50 is constructed so as to position photoreceptor drums 21*a* to 21*d* and toner conveying devices 39*a* to 39*e* alone, the present invention should not be limited to this. For example, the components inclusive of transfer belt drive roller 32, transfer belt driven roller 33 and the like, for moving the transfer belt 31 wound therebetween, may be positioned altogether. This configuration makes it possible to simplify the attachment work and maintenance work of transfer belt 31.

The color image forming apparatus 1 of the exemplary embodiment presented herein should not be limited to the above embodiment and variational examples, but various changes and modifications can be made therein without departing from the spirit and scope of the exemplary embodiment.

What is claimed is:

1. A color image forming apparatus comprising:

a plurality of image forming units, each having an image bearing member for supporting a developer image formed with a developer corresponding to a color in accordance with color-separated image information that is obtained by separating image information into plural color components and subjecting them to image processes;

an intermediate transfer medium to which a multiple number of developer images are transferred in layers;

a transfer unit configured to transfer the developer images that have been transferred in layers on the intermediate transfer medium, to a print medium; and a developer collecting section configured to collect, at least, remaining developers that have not been transferred from the image bearing members to the intermediate transfer medium but have been left over on the image bearing members and remaining developers that have not been transferred from the intermediate transfer medium to the print medium but have been left over on the intermediate transfer medium, wherein a positioning member which is set with a developer collecting container for storing the collected developers and positions at least the plurality of image forming units relative to an apparatus frame, is removably attached to the apparatus frame on one side of the apparatus frame.

2. The color image forming apparatus according to claim 1, wherein the developer collecting container is removably attached to the positioning member.

3. The color image forming apparatus according to claim 2, wherein the positioning member has a multiple number of positioning holes for positioning one end side of the plurality of image forming units with respect to a main scan direction, and the developer collecting container is disposed under the positioning holes.

4. The color image forming apparatus according to claim 3, wherein the developer collecting section includes screws for conveying and/or flattening the leftover developers collected from the plurality of image forming units and the intermediate transfer medium, and the positioning member is formed with screw engagement holes that engage the screws.

5. The color image forming apparatus according to claim 3, wherein the positioning member is constructed so as to pivot on one side edge relative to the apparatus frame and will open and close with the other side edge rotated outwards of the apparatus frame.

6. The color image forming apparatus according to claim 4, wherein developer passages for guiding the developers that have been conveyed and/or flattened to the screw engagement holes into the developer collecting container are formed extending from the screw engagement holes to the developer collecting container, in the positioning member.

7. The color image forming apparatus according to claim 4, wherein the positioning member is constructed so as to pivot on one side edge relative to the apparatus frame and will open and close with the other side edge rotated outwards of the apparatus frame.

8. The color image forming apparatus according to claim 6, wherein the positioning member is constructed so as to pivot on one side edge relative to the apparatus frame and will open and close with the other side edge rotated outwards of the apparatus frame.

9. The color image forming apparatus according to claim 2, wherein the developer collecting section includes screws for conveying and/or flattening the leftover developers collected from the plurality of image forming units and the intermediate transfer medium, and the positioning member is formed with screw engagement holes that engage the screws.

10. The color image forming apparatus according to claim 9, wherein developer passages for guiding the developers that have been conveyed and/or flattened to the screw engagement holes into the developer collecting container are formed extending from the screw engagement holes to the developer collecting container, in the positioning member.

11. The color image forming apparatus according to claim 9, wherein the positioning member is constructed so as to pivot on one side edge relative to the apparatus frame and will open and close with the other side edge rotated outwards of the apparatus frame.

12. The color image forming apparatus according to claim 10, wherein the positioning member is constructed so as to pivot on one side edge relative to the apparatus frame and will open and close with the other side edge rotated outwards of the apparatus frame.

13. The color image forming apparatus according to claim 2, wherein the positioning member is constructed so as to pivot on one side edge relative to the apparatus frame and will open and close with the other side edge rotated outwards of the apparatus frame.

14. The color image forming apparatus according to claim 1, wherein the positioning member has a multiple number of positioning holes for positioning one end side of the plurality of image forming units with respect to a main scan direction, and the developer collecting container is disposed under the positioning holes.

15. The color image forming apparatus according to claim 14, wherein the developer collecting section includes screws for conveying and/or flattening the leftover developers collected from the plurality of image forming units and the intermediate transfer medium, and the positioning member is formed with screw engagement holes that engage the screws.

16. The color image forming apparatus according to claim 14, wherein the positioning member is constructed so as to pivot on one side edge relative to the apparatus frame and will open and close with the other side edge rotated outwards of the apparatus frame.

17. The color image forming apparatus according to claim 15, wherein developer passages for guiding the developers that have been conveyed and/or flattened to the screw engagement holes into the developer collecting container are formed extending from the screw engagement holes to the developer collecting container, in the positioning member.

18. The color image forming apparatus according to claim 15, wherein the positioning member is constructed so as to pivot on one side edge relative to the apparatus frame and will open and close with the other side edge rotated outwards of the apparatus frame.

19. The color image forming apparatus according to claim 17, wherein the positioning member is constructed so as to pivot on one side edge relative to the apparatus frame and will open and close with the other side edge rotated outwards of the apparatus frame.

20. The color image forming apparatus according to claim 1, wherein the developer collecting section includes screws for conveying and/or flattening the leftover developers collected from the plurality of image forming units and the intermediate transfer medium, and the positioning member is formed with screw engagement holes that engage the screws.

21. The color image forming apparatus according to claim 20, wherein developer passages for guiding the developers that have been conveyed and/or flattened to the screw engagement holes into the developer collecting container are formed extending from the screw engagement holes to the developer collecting container, in the positioning member.

22. The color image forming apparatus according to claim 20, wherein the positioning member is constructed so as to pivot on one side edge relative to the apparatus frame and will open and close with the other side edge rotated outwards of the apparatus frame.

23. The color image forming apparatus according to claim 21, wherein the positioning member is constructed so as to pivot on one side edge relative to the apparatus frame and will open and close with the other side edge rotated outwards of the apparatus frame.

24. The color image forming apparatus according to claim 1, wherein the positioning member is constructed so as to pivot on one side edge relative to the apparatus frame and will open and close with the other side edge rotated outwards of the apparatus frame.

* * * * *